US010603894B2

(12) United States Patent
Adamson et al.

(10) Patent No.: US 10,603,894 B2
(45) Date of Patent: Mar. 31, 2020

(54) PRINTING

(75) Inventors: John David Adamson, Cumbria (GB); Peter Andrew Reath Bennett, Yorkshire (GB); Rodney Martin Potts, Yorkshire (GB)

(73) Assignee: Shenzhen Zhong Chuang Green Plate Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/635,020

(22) PCT Filed: Mar. 18, 2011

(86) PCT No.: PCT/GB2011/050550

§ 371 (c)(1),
(2), (4) Date: Sep. 27, 2012

(87) PCT Pub. No.: WO2011/114171

PCT Pub. Date: Sep. 22, 2011

(65) Prior Publication Data

US 2013/0027500 A1 Jan. 31, 2013

(30) Foreign Application Priority Data

Mar. 18, 2010 (GB) ..... 1004537.5
Dec. 20, 2010 (GB) ..... 1021671.1

(51) Int. Cl.
*B41C 1/10* (2006.01)

(52) U.S. Cl.
CPC ..... *B41C 1/1041* (2013.01); *B41C 1/1075* (2013.01); *B41C 1/1083* (2013.01); *B41C 1/1008* (2013.01); *B41C 2210/02* (2013.01); *B41C 2210/04* (2013.01); *B41C 2210/06* (2013.01)

(58) Field of Classification Search
CPC ..... B41J 2/442; B41J 2/4753
USPC ..... 347/129, 225
See application file for complete search history.

(56) References Cited

U.S. PATENT DOCUMENTS 3,636,251 A * 1/1972 Daly ..... H04N 1/32358 219/121.62
5,881,645 A 3/1999 Lenney et al.
5,925,496 A 7/1999 Ghosh et al.
6,105,500 A 8/2000 Bhambra et al.
(Continued)

FOREIGN PATENT DOCUMENTS

EP 1024958 B1 1/2003
WO 9852769 A1 11/1998
WO 2005109083 A2 11/2005

OTHER PUBLICATIONS

Coherent, Inc. Vector 1064 Nd:YAG Q-Switched, IR Lasers (Year: 2006).*

(Continued)

*Primary Examiner* — Alessandro V Amari
*Assistant Examiner* — Kendrick X Liu
(74) *Attorney, Agent, or Firm* — Hoffman Warnick LLC

(57) ABSTRACT

A method of imaging printing plates uses a single imaging device having at least one laser delivering, in an imagewise manner, pulsed electromagnetic energy of pulse duration not greater than $1\times10^{-6}$ seconds. Such an imaging method permits the imaging of a plurality of types of printing plates irrespective of any sensitised imaging chemistry contained in their coatings.

18 Claims, 2 Drawing Sheets

(56) References Cited

U.S. PATENT DOCUMENTS 6,391,522 B1* 5/2002 Nakayama ..... B41C 1/1041 430/19
6,423,468 B1* 7/2002 Hotta et al. ..... 430/270.1
6,482,570 B1* 11/2002 Hotta ..... B41C 1/1041 430/273.1
2001/0003032 A1* 6/2001 Harada ..... B41C 1/1025 430/302
2001/0053498 A1* 12/2001 Fujimoto et al. ..... 430/273.1
2002/0187425 A1* 12/2002 Savariar-Hauck .... B41C 1/1016 430/272.1
2003/0022107 A1* 1/2003 Yang et al. ..... 430/273.1
2003/0145749 A1* 8/2003 Van de Leest ..... B41C 1/1041 101/463.1
2003/0189746 A1* 10/2003 Vernackt ..... 359/237
2003/0194651 A1* 10/2003 De Voe et al. ..... 430/293
2004/0136356 A1 7/2004 Kuo et al.
2004/0168597 A1* 9/2004 Suda et al. ..... 101/453
2004/0244620 A1* 12/2004 Harada et al. ..... 101/463.1
2005/0136356 A1* 6/2005 Van Damme et al. .... 430/270.1
2006/0201360 A1* 9/2006 Andriessen et al. ..... 101/467
2008/0261028 A1* 10/2008 Regan ..... B41C 1/05 428/336
2010/0075251 A1* 3/2010 Fujii ..... B41N 3/03 430/270.1
2010/0216067 A1* 8/2010 Miller ..... G03F 7/322 430/108.4
2010/0227269 A1* 9/2010 Simpson ..... B41C 1/1008 430/270.1
2011/0174178 A1 7/2011 Adamson et al.
2011/0193268 A1* 8/2011 Kokubo ..... 264/400
2012/0132092 A1 5/2012 Adamson et al.

OTHER PUBLICATIONS

Patent Cooperation Treaty, PCT International Search Report and Written Opinion of the International Searching Authority for Application No. PCT/GB2011/050550 dated May 10, 2011, 9 pages.
Search Report for Corresponding GB Application No. GB1021671.1 dated Nov. 28, 2016, 4 pages.

* cited by examiner

PRINTING

This invention relates to improvements in printing, and in particular to a method for the preparation of substrates, including coated and uncoated substrates, for lithographic printing. It relates in addition to novel lithographic printing surfaces produced by the method; and to apparatus for use in the method.

Fundamentally, all lithographic printing processes take a printing form precursor which has a specially prepared surface which is uniform throughout; and modifies selected regions of it, leaving reciprocal regions unmodified. Many processes subject the printing form precursor to a chemical developer which acts upon either the modified or unmodified regions, to produce the differentiation needed for printing. Optionally the developed surface is treated to harden the remaining areas of the coating, for example by baking, prior to printing.

It should be noted that in this specification we use the term 'printing form precursor' to denote the initial article having a uniform surface, undifferentiated as regards the acceptance or rejection of ink; and 'printing form' to denote the article now with a differentiated surface which can be printed from. The term printing form herein may be substituted by the term printing plate, or just plate. The term printing form is preferred in describing and defining the invention because it is of broad connotation. The term printing plate or just plate may nevertheless be used herein for ease of reading.

Printing form precursors having thereon a coating of a chemical composition may be altered in their propensity to be dissolved in a developer solution, by suitable energy. In some compositions the energy renders the areas of the coating subjected to the energy more soluble in the developer. Because of the solubility differential resulting from the imagewise application of energy, on contact with the developer the imaged areas are dissolved away leaving non-imaged areas where the coating remains. Such systems are called positive working systems. The remaining areas of coating are generally oleophilic, and ink-accepting. In the dissolved-away areas the substrate is exposed, and is generally hydrophilic and able to accept the water component of the ink/water fount solution. Thus, printing may be carried out.

In alternative systems it is the areas which have been imagewise subjected to energy which are rendered less soluble than the imaged areas, so that it is the non-imaged areas in which the coating is dissolved away. Such systems are called negative working systems.

In many traditional systems the energy is ultra-violet radiation, of wavelengths approximately in the range 190-400 nm. Many positive working systems sensitive to ultra-violet radiation use quinone diazides moieties present in a polymer composition used as the coating. On exposure to ultra-violet radiation the quinone diazide (NQD) moieties break down, and in doing so render the composition more soluble in a developer. From a mechanistic point of view, on exposure to UV, the NQD inhibitor undergoes a chemical reaction which has been estimated to produce localised heating to a temperature of 200° C. This has the effect of loosening the hydrogen bonds between polymer strands thereby facilitating the ingress of applied developing fluid. Further, each exposed NQD inhibitor ejects a molecule of Nitrogen gas again creating more space for developer. It also undergoes ring contraction from a naphthalene ring structure to a benzindene structure producing a chemical product smaller in size than was present originally further creating more free space for developer to enter. This exposed chemical species is a carboxylic acid and is hence far more soluble than the original NQD and is consequently much more readily soluble in the developer. Finally this reaction is irreversible—there is no going back.

In recent years a new positive working technology for printing forms has been developed. This uses infra-red radiation of wavelength in the range 800-1400 nm. In these systems a polymer composition comprises a phenolic resin and a suitable aromatic compound such as a trimethylmethane dye, for example Crystal Violet. By use of infrared lasers, energy is delivered to selected regions of the coating, converted into heat and through loosening of hydrogen bonds as mentioned above the solubility of such regions in a developer is increased.

BRIEF DESCRIPTION OF THE SEVERAL VIEWS OF THE DRAWINGS

Although NQD and IR sensitive positive seem to behave similarly, there is actually a very large difference in the dissolution contrast (DC) between the two systems the DC being defined as the rate of dissolution of the unexposed coating compared to that of the exposed coating. FIG. 1 illustrates this difference.

Figure 1:
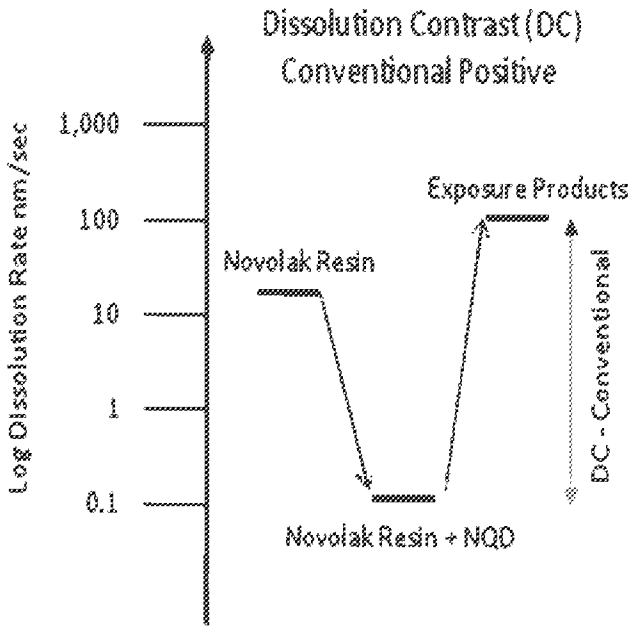
FIG. 1 shows the dissolution contrasts (DC) of thermal positive and conventional positive printing forms.
Figure 1:
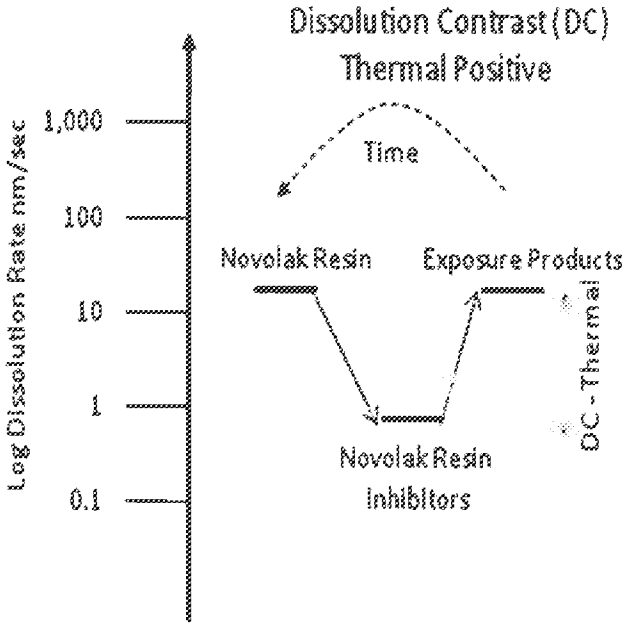
Figure 2:
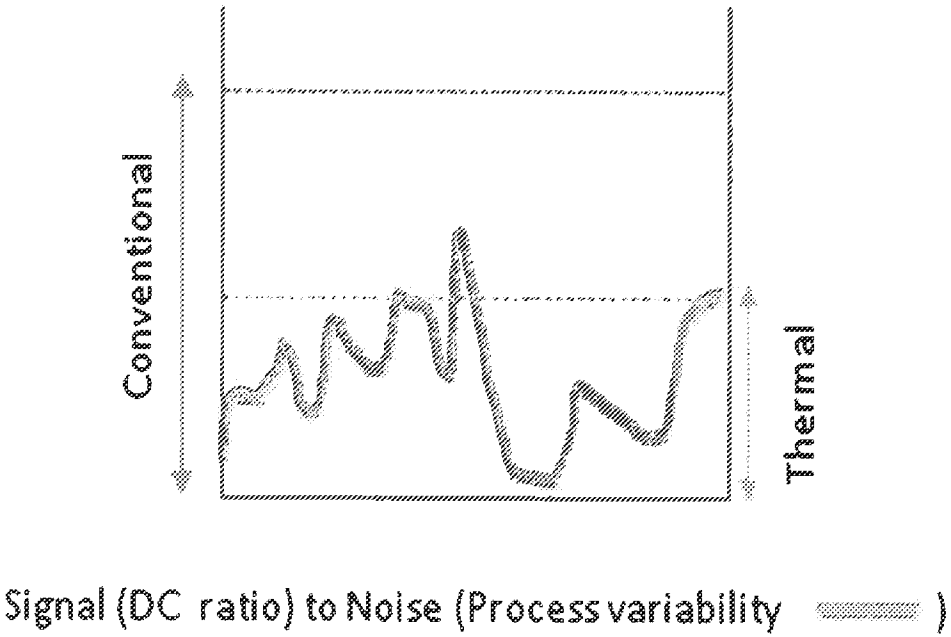
FIG. 2 shows the signal (DC ratio) to noise (process variability) in conventional and thermall-treated printing forms.

There are some very inconvenient consequences of the low DC of thermal plates. First of these is that the dependency only on hydrogen bonding makes the structure susceptible to modification by ambient temperature and temperature changes over time which results in changes to the plate sensitivity with time or temperature—a logistical problem for product within a supply chain lasting over 12 months and shipped globally to different climates. To overcome this dissatisfier, product is thermally treated for a number of days at elevated temperatures to render the plate stable in the market up to that temperature. This is a costly, additional step that also results in longer lead times to customers. EP1024958 describes such a process. A second inconvenience resulting from a low DC is that the coating is also sensitive to variation in any process that can impact on the adhesion or dissolution of the coating. This is illustrated in FIG. 2. For example in electro-chemical graining which produces hydrophilic texture on Aluminium used for printing plates, if the grain is too deep then the included volume of coating is high and the surface coating thickness is reduced, especially in areas of plateau, resulting in excessive dissolution during customer processing. This calls for much tighter control of the topography of thermal positive plates.

This weak bonding in thermal positive systems imparts a relatively low cohesive energy to the liquid coating for application which makes such coatings very susceptible to coating voids. Small contaminants on the surface of the substrate can repel the coating; when the cohesive energy of the coating is low the coating has insufficient energy to overcome the surface energy of the contaminant and a void or white spot results. Although white spots can be present on analogue NQD positive plates there are present at a significantly lower level than in thermal positive coating. Further, once the thermal coating has dried, it is prone to scratching, scuffing and pressure unlike analogue positive NQD plates again due to the relatively weak bonding of the coating.

In combination these undesirable effects in thermal positive systems create a real challenge in manufacture both in terms of product quality and product yield.

Inherent in these and other imaging systems is the concept of "wavelength matching": that the imaging energy must be coupled to the chemistry of the printing form's imageable coating.

There is, in fact, a wide variety of energy sources, and of chemical systems that are sensitive to them. For CTP (Computer To Plate) systems the energy sources include UV lasers (~350 nm wavelength), argon ion lasers (~488 nm wavelength), frequency doubled YAG lasers (532 nm wavelength), LEDs (670 nm and 780 nm), YAG lasers (1064 nm), IR diode lasers (810 NM and 830 nm) and violet diode lasers (405 nm).

In addition to wavelength matching, different imaging systems require lasers of different power, or operated at different powers.

This means that the user must select hardware (imaging devices) and media (imaging systems/coating chemistries) as "matching pairs". This limits the user's choice and flexibility. The user may be locked into a particular "matching pair" (hardware/media) with all the obvious negative cost implications.

A further point about wavelength sensitive plates is that they must be handled in an environment of non-actinic light. So UV sensitive plates must be handled in yellow light, green sensitive plates must be handled in red light etc. In fact one advantage of thermal positive plates is their ability to be handled in normal white light as they are not sensitive to visible light. Thus, there is advantage to utilise a plate coating that employs high DC coating yet is not sensitive to ambient white light and that is easy and cost effective to manufacture.

It is an object of the present invention to improve the limiting situation we have described above.

In accordance with a first aspect of the present invention there is provided a method of imaging a plurality of types of printing form precursors using a single imaging device having at least one laser delivering, in an imagewise manner, pulsed electromagnetic radiation of pulse duration not greater than $1\times10^{-6}$ seconds, wherein the types of printing form precursors imagable in the method include at least two, and preferably all three, of the following:

(i) a first printing form precursor, having an imaging surface which does not have sensitised imaging chemistry;

(ii) a second printing form precursor having an imaging surface which has sensitised imaging chemistry responsive to radiation of wavelength within the range 150 to 700 nm;

(iii) a third printing form precursor having an imaging surface which has sensitised imaging chemistry responsive to radiation of wavelength within the range 700 to 1400 nm.

In the method different types of printing form precursor may be imaged individually, at different times, possibly over an extended period. In practice a printer may image and print from, for example, a batch of printing form precursors, say (i), followed by a different batch, say (ii) or (iii).

The term "sensitised imaging chemistry" herein denotes the use of coating chemicals provided at the surface on the printing plate precursor which are intended to respond to a certain wavelength of electromagnetic radiation, or frequently to a narrow band of radiation, to produce a desired change on the surface. For example the electromagnetic radiation may cause a chemical change, for example a chemical reaction, or a chemico-physical change, for example the forming or breaking of hydrogen bonds, to render the imaged region of a coating more soluble, or less soluble, in a developer liquid. The change normally requires a narrow Gaussian peak of electromagnetic radiation. The chemistry may be regarded as "tuned" to that wavelength or peak.

The imaging device may also be called a platesetter herein.

In accordance with a second aspect of the present invention there is provided a printing form precursor imaged by a method of the first aspect.

In accordance with a third aspect of the present invention there is provided an imaging device having a laser adapted to deliver, in an imagewise manner, pulsed electromagnetic energy of pulse duration not greater than $1\times10^{-6}$ seconds, to at least two, and preferably three, of the types of printing form precursor defined above as types (i), (ii) and (iii).

In accordance with a fourth aspect of the present invention there is provided the use of an imaging device having a laser adapted to deliver, in an imagewise manner, pulsed electromagnetic energy of pulse duration not greater than $1\times10^{-6}$ seconds to the image surface of a printing form precursor, thereby to image the printing form precursor irrespective of any sensitised imaging chemistry which the printing form precursor may have. As noted elsewhere the printing form precursor may have a sensitised imaging chemistry which is effectively bypassed or over-ridden by this type of electromagnetic energy, or may have no sensitised imaging chemistry.

In accordance with a fifth aspect of the present invention there is provided imaging apparatus comprising in combination:

an imaging device having a laser adapted to deliver, in an imagewise manner, pulsed electromagnetic energy of pulse duration not greater than $1\times10^{-6}$ seconds, and a first printing form precursor able to be located in the imaging device for imaging, and having an imaging surface which has sensitised imaging chemistry, and a second printing form precursor able to be located in the imaging device for imaging, and having an imaging surface which has different sensitised imaging chemistry or no sensitised imaging chemistry.

In this fifth aspect the imaging device, and the first and second printing form precursors may be located in different parts of a print premises and still be considered as parts in combination, since when it is desired to use the imaging device to image a respective first or second printing form precursor it is simply brought to the imaging device.

The following definitions in this specification apply to all aspects of the invention.

A suitable imaging device images the printing form precursors in sequence, preferably one at a time. Preferably it has one imaging zone and the imaging zone may receive printing form precursors sequentially, preferably one at a time. The imaging device may however be loaded with more than one precursor. Alternatively, precursors may be loaded one at a time.

The imaging energy delivered in the method may suitably be visible, ultra-violet or infra-red radiation. For the purpose of this specification these may be 150-380 nm, 380-700 nm and 700-1400 nm, respectively.

Printing form precursor type (i) has no sensitised imaging chemistry. That is not to say it has no radiation-associated chemistry. It could be coloured. However it has no sensitised imaging chemistry as described herein.

One type of sensitised imaging chemistry of printing form precursor type (ii) is preferably responsive to electromagnetic radiation of wavelength within the range 150-380 nm, most preferably between 280 and 380 nm.

Another type of sensitised imaging chemistry of printing form precursor type (ii) is preferably responsive to electromagnetic radiation of wavelength within the range 380-700 nm, most preferably between 390-600 nm.

The sensitised imaging chemistry of printing form precursor type (iii) is preferably responsive to electromagnetic radiation of wavelength between 750 and 1200 nm.

In a method in accordance with the invention, it is possible to individually image a plurality of different types of printing form precursors, using the one imaging device. Preferably it is possible to image numerous, for example four, five, six, seven or eight different types of printing form precursors, in a sequence, using the one platesetter. Such printing form precursors may be selected from:

- a printing form precursor whose imaging surface does not have any sensitised imaging chemistry but which can be switched from hydrophobic to hydrophilic, or vice-versa, by the imaging device
- a positive working analogue printing form precursor having an imaging surface with a sensitised imaging chemistry responsive to radiation between 190 and 420 nm, preferably between 350 and 420 nm
- a negative working analogue printing form precursor having an imaging surface with a sensitised imaging chemistry responsive to radiation of wavelength between 190 and 420 nm, preferably between 350 and 420 nm
- a thermally sensitive digital (Computer to Plate, CtP) positive working printing form precursor having an imaging surface responsive to radiation of wavelength between 700 and 1400 nm, preferably between 750 and 1200 nm
- a thermally sensitive digital (Computer to Plate, CtP) negative working printing form precursor having an imaging surface responsive to radiation of wavelength between 700 and 1400 nm, preferably between 750 and 1200 nm
- a UV/visibly sensitive digital (Computer to Plate, CtP) negative working printing form precursor having an imaging surface responsive to radiation of wavelength between 280 and 700 nm, preferably between 350 and 700 nm
- a printing form precursor adapted to be imaged by ablation of its surface, when exposed to suitable radiation of any wavelength
- a printing form precursor with coating chemistry, for example silver halide chemistry, which causes it to be imaged when exposed to radiation between 200 to 1200 nm, preferably between 320 and 740 nm.
- a single use printing form precursor with a polymer, metal, metal uncoated oxide or ceramic printing surface that does not need any processing (development)
- a multi-use uncoated printing form precursor with a polymer, metal oxide or ceramic printing surface that does not need any processing (development).

It will be appreciated from the earlier discussion about DC ratios, that the potential numerous benefits derived from the usage of high DC ratio printing forms are available to varying degrees from a number of these categories, most especially 'a positive working analogue printing form precursor having an imaging surface with a sensitised imaging chemistry responsive to radiation between 190 and 420 nm, preferably between 350 and 420 nm'.

By "uncoated printing form precursors" we mean printing form precursors which are not coated with a sensitised imaging chemistry (i.e. image-forming chemical coating), undergoing a development step after imaging or at the same time as imaging.

In the present invention the incident radiation emitted by the laser may or may not overlap with the region of electromagnetic spectrum in which the printing form precursor it intended to be imaged (that is, the region of the spectrum in which any sensitised imaging chemistry is activated); it does not matter. What we have found is that when using fast pulse laser energy imaging can take place irrespective of any sensitised imaging chemistry at the image surface; or in the absence of any sensitised imaging chemistry in a coating; or in certain embodiments in the absence of any coating at all.

The printing form precursor of type (i) above is preferably a multi-use printing form precursor. By this we mean a precursor which can be imaged, then used in printing; then restored to an undifferentiated form, imaged, then used in printing; preferably over at least 5 imaging and restorative cycles. A printing form precursor of type (i) is a preferred precursor imaged in the method.

Imaging using the defined type of electromagnetic radiation is followed by printing. There may be a separate stage of development in some embodiments in which the latent imaging pattern produced in a coating is developed into the actual imaging pattern having more strongly hydrophilic regions and less strongly hydrophilic regions. However not all printing form precursors need a separate development step, or indeed any development step. For example uncoated printing form precursors need no development step because the imaged surface is already differentiated into the desired more strongly hydrophilic regions and less strongly hydrophilic regions.

Preferably the wavelength of the laser is in the range 150 to 1400 nm.

Preferably the wavelength of the laser radiation is not altered, in the method of the first aspect.

Preferably, the wavelength of the laser cannot be altered, in the imaging device.

Preferably, the pulse duration of the laser radiation is not altered, in the method. Preferably the pulse duration of the lasers cannot be altered, in the imaging device.

Preferably the amount of energy delivered in the method may be altered by adjusting the power output of the imaging device. Thus the imaging device has means for adjusting this parameter.

Preferably the amount of energy delivered in the method may be altered by adjusting the overall exposure time. Thus the imaging device has means for adjusting this parameter.

The imaging energy is delivered by ultra-short pulse or ultra-fast lasers. Preferably the lasers emit suitable pulses as such (i.e. is a dedicated pulse generator); preferably it is not a continuous wave laser whose output is modulated post-emission to form "pulses". Preferably it is not a continuous wave (CW) laser whose output is modulated by electronic control of the laser power source. In such cases the power delivered by the "pulse" is no different, or not substantially different, from the power delivered by the non-modulated continuous wave output. In contrast it is preferred that the present invention uses pulses of intense power.

Suitable lasers for use in this invention may operate by Q switching, in which energy is built up to be released as pulses in avalanche events; mode locking, which uses optical interference to produce pulse-shaped "beats" of light; Cavity Dumping, in which a "door" is opened periodically to "dump" a burst of light; and Gain Switching, in which pulses are formed by quickly switching the optical gain in the laser medium used to generate the laser light.

Preferably the pulses are of duration not greater than $5\times10^{-7}$ seconds, preferably not greater than $1\times10^{-7}$, preferably not greater than $5\times10^{-8}$, preferably not greater than $1\times10^{-8}$ seconds, preferably not greater than $5\times10^{-9}$ seconds, preferably not greater than $1\times10^{-9}$ seconds, preferably not greater than $5\times10^{-19}$ seconds, preferably not greater than $1\times10^{-19}$ seconds, preferably not greater than $5\times10^{-11}$ seconds, preferably not greater than $1\times10^{-11}$ seconds. In some embodiments they may be of duration not greater than $5\times10^{-12}$ seconds, preferably not greater than $1\times10^{-12}$ seconds, preferably not greater than $1\times10^{-13}$ seconds.

Preferably the pulses of electromagnetic radiation, preferably from an ultra-short pulse or ultra-fast laser, are of duration at least $1\times10^{-18}$ seconds, preferably at least $1\times10^{-16}$ seconds, preferably at least $1\times10^{-15}$ seconds, preferably at least $5\times10^{-15}$ seconds, preferably at least $1\times10^{-14}$ seconds, preferably at least $5\times10^{-14}$ seconds, preferably at least $1\times10^{-13}$ seconds. In some embodiments they may be of duration at least $5\times10^{-13}$ seconds, preferably at least $1\times10^{-12}$ seconds, preferably at least $5\times10^{-12}$ seconds.

The pulses could be produced by a generator working at a fixed frequency, or in a region around a fixed frequency. Alternatively the pulses may be generated by a signal derived from the plate processing apparatus. Such a signal could typically have a small variation in frequency, or may have a large range in frequency, possibly starting from 0 Hz. In all these cases there can be identified an average frequency of pulsing that would occur over the processing of a whole plate, and possibly a maximum frequency that may depend on the specification of the electromagnetic source or the specification of the plate exposure apparatus (platesetter). The average processing frequency is an important parameter of the production rate of the platesetter.

The average frequency of pulsing is preferably at least 100 pulses per second (100 Hz). Preferably it is at least 1000 pulses per second (1 kHz), preferably at least $10^4$ pulses per second (10 kHz), preferably at least $10^5$ pulses per second (100 kHz), and preferably at least $10^6$ pulses per second (1 MHz). In certain embodiments it could be higher, for example at least $10^7$ pulses per second (10 MHz), or at least $5\times10^7$ pulses per second. These repetition rates are in the range 0.0001 MHz to 50 MHz, or higher, and might be expected to lead to plate production speeds, e.g. within a platesetter, of up to approximately 45 plates per hour.

The delivery of the electromagnetic radiation may be even over time but this is not an essential feature of the invention. If the delivery of electromagnetic radiation varies over time, for example using a frequency sweep, definitions of parameters such as pulse duration and pulse separation given herein are to be taken as average values.

A convenient measure of the energy requirement of the process for forming a process plate is to determine the energy density (energy per unit area) required to achieve the necessary changes in the plate surface. Where the electromagnetic energy is delivered continuously (continuous wave) at a Power, P (Watts) into a defined spot of diameter D (cm) (or for a non circular spot, some measure of the linear extent of that spot, e.g. the side length of a square spot) then the Power Density, i.e. Watts per unit area, is the Power divided by the spot area. It is common practice to ignore any numerical scaling factor for similar spot shapes, i.e. for a circular spot it is common to divide the power by the square of the diameter, $P/D^2$. To get the energy density it is necessary to estimate the time that the spot is exposed for. A simple estimate of this is to take the time that the beam takes to traverse the spot, i.e. the spot diameter divided by the traverse speed, v (cm/s) of the electromagnetic beam. This is D/v. The energy density is the power density multiplied by the exposure time, which is given by the formula P/Dv ($J/cm^2$). This definition for the energy density is commonly referred to as the "Specific Energy" of a continuous wave process.

However this invention uses pulsed radiation. For a pulsed electromagnetic beam the situation is more complicated. The simplest analysis is when each pulse of the source exposes a unique and previously unexposed spot on the surface. Furthermore if the beam is stationary at the arrival and throughout the duration of the pulse, then the energy density can be simply calculated. The beam power during the pulse can be estimated as the energy of the pulse, E (J), divided by the pulse length (s). The Power density is defined as this power divided by the spot area as discussed previously. However the exposure time is now solely the length of the pulse (s) and so the energy density becomes simply the pulse energy divided by the spot area, $E/D^2$. This energy density is commonly referred to as "Fluence" in the literature.

Normally it is not desirable to stop the beam movement to deliver pulses as this introduces delays and does not optimise the throughput of the process. Thus the beam traverses the surface during the extent of the pulse. This can be regarded as elongating the spot in the direction of beam travel by an extent given by multiplying the traverse speed v by the pulse length T, with the spot area now being defined as D(D+TV). The formula for fluence, F, becomes:

$$F=E/(D(D+TV)=E/D^2(1+TV/D)$$

If TV/D<<1 then the effect of traverse speed can be ignored. For a spot size of 20 μm travelling at 1 $ms^{-1}$ and a pulse length of 10 pS then $TV/D=5\times10^{-7}$ so the effect of travel speed on the fluence can be safely ignored.

Another factor is related to pulse overlap. If the speed is sufficiently high for a given frequency then the individual pulses do not overlap on the surface of the material. For this to happen then it is simple to show that fD/v<1, where f is the repetition frequency of the pulsed electromagnetic source. When the traverse speed is such that the pulses are not spatially separated then the effect of overlapping pulses on the material surface may have to be considered. It is common in the literature of short pulsed laser processing to refer to the effect of overlapping pulses as "incubation" and to measure the degree of incubation by estimating the number of overlapping pulses, N, as N=fD/v. N is sometimes referred to as the incubation number or incubation factor and does not need to be an integer. If N<1 there is no overlap of pulses. When N=1 (which is preferred) the exposure spots of successive pulses are touching, and as N increases there is increasing overlap of spots. For low values of N, say N<5, there may be little influence on incubation. However at high values of N a process may be regarded as a "quasi CW" process, and the energy density may be better expressed in terms of "Specific Energy".

Finally after a substantial area of, or the whole of, a plate has been exposed then an additional pass, or passes may be made. These additional passes may increase or add to the material changes created by previous passes.

The present invention preferably employs a low value of N; thus "fluence", in $mJ/cm^2$, is regarded as the most appropriate definition of energy density, for use in this invention.

Preferably the fluence in the method of the present invention is at least 1 mJ/cm$^2$, preferably at least 50 mJ/cm$^2$, for example at least 100 mJ/cm$^2$.

Preferably the fluence in the method of the present invention is not greater than 20,000 mJ/cm$^2$, preferably not greater than 10,000 mJ/cm$^2$, preferably not greater than 5,000 mJ/cm$^2$, preferably not greater than 2,000 mJ/cm$^2$, preferably not greater than 1,000 mJ/cm$^2$, preferably not greater than 500 mJ/cm$^2$, preferably not greater than 200 mJ/cm$^2$. It may be not greater than 100 mJ/cm$^2$, and in some embodiments not greater than 50 mJ/cm$^2$.

Preferably the pulse energy (energy per pulse) delivered in this method is at least 0.1 μJ, preferably at least 0.5 μJ, and preferably at least 1 μJ.

Preferably the pulse energy (energy per pulse) delivered in this method is up to 50 μJ, preferably up to 20 μJ, preferably up to 10 μJ, and preferably up to 5 μJ.

Preferably a region to be imaged in the method is subjected to one pass or traverse only, of the beam of electromagnetic imaging radiation. However in other embodiments a plurality of passes may be employed, for example up to 10, suitably up to 5, for example 2. In such embodiments the first pulse has a pulse energy as defined above. Subsequent pulse(s) may have a pulse energy as defined above but this need not be the same pulse energy as the first pulse, or any other pulses; for example it may advantageously be less.

When multipass laser imaging is employed, it is intended that passes are made without significant delay between them and without treatments being applied between them (other than, if necessary, debris removal). It is desirable that any such treatments are carried out without removal of the plate from the imaging device (which may also be called the platesetter). Preferably, however, no such treatments are required and the multipass imaging process is carried out in one stage (as opposed, for example, to two stages separated by a dwell time).

As noted above an imaging method which is ablative in nature is not excluded in the practice of the invention. However, preferably the method of the invention does not cause ablation; or, if it does, causes only insubstantial ablation; for example ablation at a level which does not require removal of debris.

The pulse may generate a spot or pixel of any shape, for example circular, oval and rectangular, including square. Rectangular is preferred, as being able to provide full imaging of desired regions, without overlapping and/or missed regions.

Preferably the pulsed radiation is applied to an area of less than $1\times10^{-4}$ cm$^2$ (e.g. a 113 μm diameter circle), preferably less than $5\times10^{-5}$ cm$^2$ (e.g. a 80 μm diameter circle), preferably less than $1\times10^{-5}$ cm$^2$ (e.g. a 35 μm diameter circle).

Preferably the pulsed radiation is applied to an area preferably greater than $1\times10^{-7}$ cm$^2$ (e.g. a 3.5 μm diameter circle), preferably greater than $5\times10^{-7}$ cm$^2$ (e.g. a 8 μm diameter circle), preferably greater than $1\times10^{-6}$ cm$^2$ (e.g. a 11 μm diameter circle).

The natural profile of a laser beam, by which is suitably meant the energy or intensity, is Gaussian; however other beam profiles are equally suitable to carry out the change described herein, especially laser beams with a square or rectangular profile (i.e. energy or intensity across the laser beam). The cross-sectional profile of the laser beam may be circular, elliptical, square or rectangular and preferably the intensity of the laser beam energy (or "profile" of the laser beam) is substantially uniform across the whole area of the cross-section.

Preferably the method employs, as the imaging devices, nanosecond, picosecond or femtosecond lasers. Such lasers provide pulses of high intensity; they are not adapted or gated CW lasers. Alternatively the method may employ, as the imaging device, a nanosecond laser fitted with a device, such as a Q-switch, to release intense pulses of laser energy "stored" during dwell times (in which the laser was still pumped but not releasing the photon energy produced).

One type of laser preferred for use in the present invention is a femtosecond laser, for example emitting pulses of pulse duration in the range 50-400, for example 100-250, femtoseconds (fs).

Another type of laser preferred for use in the present invention is a picosecond laser, for example emitting pulses of pulse duration in the range 1-50, for example 5-20, picoseconds (ps).

In non-ablative embodiments of the invention the imaging energy preferably does not produce substantial heat at the impinged-upon surface.

Ultra-fast fibre lasers may be used, in which a chemically treated ("doped") optical fibre forms the laser cavity. This optical fibre is "pumped" by laser diodes, and there are several proprietary technologies used to couple the pumped light from the laser diodes into the optical fibre. Such lasers have relatively few optical components and are inexpensive, efficient, compact and rugged. They are thus considered to be especially suitable for use in this invention. However other ultra-short pulse or ultra-fast lasers may be used.

On the platesetter, to laser-expose a plate the laser, the plate, or both have to move so that the whole plate surface can be addressed—the process called rastering. The arrangement of the laser within a platesetter (frequently referred to as the 'architecture') can be accomplished in one of three basic ways. Each of these architectures may be used in the present invention, and has its own performance differences, advantages and disadvantages. In the Flat Bed architecture, the plate is mounted flat on a table and the laser scans across, then the table moves down by one pixel and the laser scans back again. In the Internal Drum architecture the plate is fixed into a shell and the imaging laser rotates at high speed in the centre of the drum (in most but not all internal drum setters the plate remains still and the laser moves laterally as well as longitudinally). In the third architecture, External Drum the plate is clamped onto the outside of a cylinder, and the laser (or quite commonly a number of, for example, laser diodes) is mounted on a bar; usually the cylinder rotates and the laser(s) track across the plate.

The platesetter is driven by software that is capable of controlling the output to form a desired pattern of exposure pixels on the plate surface. The control may be applied to conventional half-tone (amplitude modulated) or to frequency modulated (stochastic) screening methods.

A method which involves transferring the printing form precursor between the imaging device and a printing press may require a printing form precursor which can be reconfigured between a flat shape (when on the imaging device) and a cylindrical shape (when on the printing press). Such a printing form precursor requires flexibility. Certain of the printing form precursors described above are sufficiently flexible to be reconfigured between flat and cylindrical forms several times, without distortion in its shape or damage to the printing surface. One example is a printing form precursor having a plastics base layer, for example having a polyester layer, for example of average thickness in the range 25 to 250 μm, preferably 100 to 150 μm, and an aluminium oxide layer, for example of average thickness as described above, and optionally carrying an image layer of a polymeric material of thickness in the range 0.5 to 5 μm. Between the polyester layer and the aluminium oxide layer there may advantageously be an aluminium layer of average thickness in the range 10 to 50 μm, preferably 20 to 30 μm. Non-metallic (and metallic) substrates having metal oxide layers, or able to carry metal oxide layers, are described in U.S. Pat. Nos. 5,881,645, 6,105,500 and WO 98/52769 and they and variations thereof may provide flexible and non-brittle printing form precursors of utility in the present invention.

The printing form precursor may be a flat plate, a plate with a curved surface, for example a roller, e.g. for use on a printing press, or cylinder or sleeve for a cylinder, in each case, suitable for use on a printing press.

A substrate for use in this invention may be a metal sheet provided with a metal compound (for example a metal oxide or sulphide printing surface. The latter is preferably different from that which would be achieved by oxidation or sulphidation under ambient conditions). For example when the process of producing the substrate employs, for example anodisation, it may produce a metal oxide printing surface which is thicker and/or more durable than would otherwise be the case.

A metal substrate may be both grained and anodised, for example electrochemically grained, and electrochemically anodised.

Preferably a said metal compound has an average thickness in the range 0.05 to 20 gsm (grams per square metre), preferably 0.1 to 10 gsm, preferably 0.2 to 6 gsm, preferably 1 to 4 gsm.

A preferred metal oxide layer used in this invention may be anodised and subjected to a post-anodic treatment (PAT). Suitable post-anodic treatments include treatments by, for example, poly(vinylphosphonic acid), inorganic phosphates and fluoride-containing materials such as sodium fluoride and potassium hexafluorozirconate. However embodiments in which the substrate is not subjected to a post-anodic treatment are not excluded.

In the use of the imaging device of the invention the imagable surface of the printing form precursor has a surface, and the surface is modified by the incident pulsed radiation so as to alter its ink-accepting property. It may be altered to become ink-accepting (reciprocal areas, non-imaged, being non-ink-accepting). Alternatively it may be altered to be non-ink-accepting (the reciprocal areas, non-imaged, being ink-accepting). Preferably in this embodiment no development is needed. The surface may be of a coating on a substrate or the substrate surface itself.

The modification of the surface, using the imaging method of the invention, may be to render it more hydrophilic, or less hydrophilic. For example a hydrophobic surface may be rendered hydrophilic; or a hydrophilic surface may be rendered hydrophobic. The assessment of the change which a surface has undergone is easily determined by examining the wetting of the surface by water. Water readily wets a hydrophilic surface, but forms beads on a hydrophobic surface. The contact angle of the water to the surface may be measured to give a quantitative value.

In the present invention the imaging, as defined, preferably decreases the contact angle; that is, the surface is preferably rendered more hydrophilic.

The modification described may reverse, or may be reversed, for example by delivery of a suitable heat or electromagnetic radiation. In preferred embodiments it self-reverses, over time, for example within 24 hours. A reversing means to effect such a reversal may be employed when the modification would not self-reverse; or when it would self-reverse, but more slowly than is desired.

"Reversal" means that the differentiation caused by the imaging of the present invention substantially disappears, so that what was recently the "printing form" has of itself now become, once again, a "printing form precursor", so that it can be used again. Anodised aluminium printing forms and anodised titanium printing forms are preferred substrates exhibiting this phenomenon.

The printing surface of such a substrate may preferably be aluminium oxide or titanium oxide.

The printing form may preferably comprise an aluminium or titanium substrate, on which the respective aluminium oxide or titanium oxide printing surface is disposed.

The printing form precursor for use in this invention may be a plastics or plastics-containing sheet (preferably a polyester sheet or a fibre-reinforced plastics sheet, for example glass reinforced plastics (GRP), for example glass-reinforced epoxy resin sheet) onto which the metal compound is applied.

In embodiments of the present invention the printing form precursor has a coating, and the coating is modified by the incident pulsed radiation so as to alter its solubility in a developer. It may be altered so as to be preferentially removed by a developer, and expose ink-accepting regions. It may be altered to be preferentially removed by a developer, and expose non-ink-accepting regions. It may be altered to become preferentially resistant to dissolution by a developer, so that, instead, non-imaged areas are exposed, and are preferentially ink-accepting. It may be altered to become preferentially resistant to dissolution by a developer, so that non-imaged areas are exposed, and are preferentially non-ink-accepting.

As noted above, suitable methods may be reversible. The change in character of the surface or coating induced by the pulsed radiation may be removed by an overall energy density supplied to the surface—for example by overall heating or by an overall exposure to electromagnetic radiation, or by laser-scanning using a raster pattern traced over the entire surface; or by contacting the surface or coating with an appropriate liquid; or it may occur naturally, without any intervention.

Embodiments of the invention may be positive working or negative working.

Preferred methods of the present invention do not include photopolymerization processes.

The invention will now be further described, by way of example, with reference to the following examples.

EXAMPLE SET 1

In this set of experiments a range of commercially available printing plates were exposed to ultra-fast (u-f) laser radiation, and the threshold energy density (fluence) requirements for a) development and b) ablation were recorded. For clarity, Table Ref indicates the processes and mechanisms by which these commercially available products are believed to operate under normal (i.e. unlike as to be described in this invention) conditions.

TABLE REF

| Product name | Chemistry | Mechanism | Polarity | Processing | λ max (nm) | Conv. | CTP |
|---|---|---|---|---|---|---|---|
| Fuji FPSE | 2,1,5-NQD/ Phenolic Resin | Photo-solubilisation | +ve | Alkaline | 380-420 | ✓ | |
| Kodak New Capricorn | 2,1,4-NQD/ Phenolic Resin | Photo-solubilisation | +ve | Alkaline | 380-420 | ✓ | |
| Agfa Amigo | Latex particles | Thermal coalescence | −ve | Neutral | 800-850 | | ✓ |
| Rekoda Thermax | Inhibited Phenolic Resin | Photo-solubilisation | −ve | Alkaline | 800-850 | | ✓ |

The printing plates were both analogue (conventional—Cony.) and CTP (Computer to Plate, digital) commercial lithographic printing plates. Both the analogue plates (Fuji FPSE, Kodak New Capricorn) and the CtP plates (Agfa Amigo, and Rekoda Thermax) were exposed using a Clark ultra-fast laser operating under the following conditions: frequency of 1 kHz, 50 μm spot size and pulse width of 240 femtoseconds (fs), and either 388 nm or 775 nm wavelength. The Agfa Amigo and the Fuji FPSE plates were also exposed using a Fianium laser, frequency of 500 kHz, 30 μm spot size, pulse width of 10 picoseconds (ps), and 1064 nm wavelength. Development (when required) employed the developer recommended for the particular plate, under the standard conditions. Plate assessment used standard techniques well known to persons skilled in the art.

The results are set out in Tables 1 to 3 below.

TABLE 1

1. Clark femtosecond laser, 388 nm, 240 fs, 50 μm spot size, 1 KHz:

| Plate | Threshold for | Energy μJ (per pulse) | Track speed mm/sec | Energy Density (fluence) mJ/cm$^2$ |
|---|---|---|---|---|
| Agfa Amigo | Development | 2 | 20 | 102 |
| | Ablation | 3.5 | 10 | 178 |
| Rekoda | Development | 1 | 10 | 51 |
| Thermax | Ablation | 2 | 15 | 102 |
| Fuji FPSE | Development | 1.27 | 20 | 65 |
| | Ablation | 4.45 | 20 | 227 |
| New | Development | 1.27 | 15 | 65 |
| Capricorn | Ablation | No ablation up to 4.45 | 2 | 227 |

TABLE 2

2. Clark femtosecond laser, 775 nm, 240 fs, 50 μm spot size, 1 KHz:

| Plate | Threshold for | Energy μJ Per pulse | Track speed mm/sec | Energy Density (fluence) mJ/cm$^2$ |
|---|---|---|---|---|
| Agfa Amigo | Development | 3.1 | 10 | 158 |
| | Ablation | No ablation up to 5.5 | 10 | 280 |
| Rekoda | Development | 1.5 | 20 | 76 |
| Thermax | Ablation | 3.1 | 10 | 158 |
| Fuji FPSE | Development | 3.5 | 20 | 178 |
| | Ablation | 5 | 100 | 255 |
| New | Development | 1.27 | 15 | 65 |
| Capricorn | Ablation | 4.45 | 2 | 227 |

TABLE 3

3. Fianium Laser 1064 nm, 10 picosec, 30 μm spot size: Threshold for development:

| Plate | Energy μJ (per pulse) | Track Speed mm/sec | Hz | Energy Density (fluence) mJ/cm$^2$ |
|---|---|---|---|---|
| Agfa Thermal | 1.9 | 200 | 500K | 269 |
| | 0.24 | 50 | 20M | 34 |
| Fuji FPSE | 2.9 | 100 | 500K | 410 |

Note:
Fuji FPSE starts to ablate at 2.9 μJ, 500 KHz, track speed 50 mm/sec.

It has thus been shown that an ultra-fast (u-f) laser can be used to expose both analogue and CtP printing plates, independently of the wavelength the plates are sensitised to. They may be exposed to the extent that development can be carried out with a u-f laser at an energy density (fluence) of about 50-200 mJ/cm$^2$ and ablation may take place at an energy density (fluence) of about 100-300 mJ/cm$^2$. These u-f laser exposure requirements compare with traditional UV exposure needs of around 100-300 mJ/cm$^2$ for analogue plates and 100-120 mJ/cm$^2$ for CtP plates. Additionally, for ablation of commercial CtP thermal products, typically energy needs for laser diode exposure would be around 500 mJ/cm$^2$. Additionally, for the conventional plates imaged at the 'Development' energies, excellent dissolution contrast (DC) was observed.

EXAMPLE SET 2

In this set of experiments the exposure of anodised aluminium sheets to ultra-fast (u-f) laser radiation was examined.

This set of experiments started with freshly prepared aluminium oxide/aluminium substrate, 0.3 mm gauge (degreased, grained roughened, desmutted and anodised, coating weight of 2.5 gm$^{-2}$, without being post-anodically treated) has a contact angle with water of around 15°. Contact angle means the angle between the surface of a drop of water and the printing surface of the substrate, where the water comes into contact with the printing surface.

When the substrate was allowed to age for four or five days the contact angle increased, until it reached a maximum of around 70°, as shown in Table 1 below. In other words the surface went from hydrophilic to hydrophobic.

TABLE 1

Effect of ageing after production on contact angle of water on an aluminium oxide/aluminium substrate:

| | Time after manufacture | | | | | |
|---|---|---|---|---|---|---|
| | 5 mins | 6 hours | 24 hours | 48 hours | 96 hours | 120 hours |
| Contact angle | 15° | 20° | 30° | 50° | 65° | 70° |

On exposure of an 'aged' (>48 hours), hydrophobic, aluminium oxide/aluminium substrate to an ultra-fast laser beam (Clark ultra-fast laser operating under the following general conditions: wavelength of 775 nm, 30 μm spot size, pulse width 180 fs and with an energy density (fluence) of around 225 mJ/cm$^2$), the contact angle was reduced to ~20° i.e. the exposed area became more hydrophilic. The contact angle then stayed fairly constant for some 12 hours and then started to increase fairly rapidly so that some 16-18 hours after exposure, the contact angle was around 70° once more and the printing surface was once again hydrophobic. This is shown by the results in Table 2 below.

TABLE 2

Effect of time after u-f ("ultra-fast laser") exposure on contact angle of water on an aluminium oxide/aluminium grained and anodised substrate:

| | Time after exposure | | | | | |
|---|---|---|---|---|---|---|
| | 5 mins | 1 hour | 4 hours | 12 hours | 16 hours | 18 hours |
| Contact angle | 20° | 20° | 20° | 30° | 55° | 70° |

In further experimental work re-exposure of the printing surface described above >24 hours after the initial exposure and under laser conditions corresponding to those described above, again brought about a reduction in contact angle (i.e. an increase in hydrophilicity). This effect was observed for at least 5 exposure/re-exposure 'cycles'.

It has been observed that reversion (i.e. to a hydrophobic state) occurs more rapidly the more time a printing surface has been exposed, and further suggests that measures to advance or retard the reversion of the printing form precursor may be feasible.

The results indicate the potential of u-f lasers to provide a 'reversible' or 'rewriteable' printing plate system.

EXAMPLE SET 3

To further investigate the potential for the 'multiple' exposure and 'multiple' printing of an ultra-fast exposed aluminium plate, the following experiment was conducted. A grained and anodised aluminium plate ('standard' treatments as identified above, 2.5 gm$^{-2}$ anodic weight) was exposed (exposure 1) using an ultra-fast laser (Clark ultra-fast laser operating under the following general conditions: frequency of 1 kHz, 50 μm spot size, pulse width 240 femtoseconds and fluence of 225 mJ/cm$^2$). The exposure target image comprised two '50% tint' chequers and a non-printing image 'moat' around the chequer patterns (this, to prevent the oleophilic surrounding areas 'swamping' the non-printing image areas and masking any print differential). A simple offset press test (print test 1) was conducted on this as-imaged plate on a Heidelberg GTO press. Print testing took place within two and a half hours of the ultra-fast laser exposure being completed. After adjustment of ink water balance, 250 good quality prints were obtained, before printing was terminated.

The plate was then removed from the press, excess ink was removed from the plate and the plate was 'reverted' artificially to its hydrophobic state by heating at 150° C. for one hour followed by a 'relaxation' period of 30 minutes under ambient conditions. The plate was then subjected to the same exposure conditions (exposure 2) as in exposure 1 above and again placed on the printing press. After ink water balance adjustments, 250 good quality prints (print test 2) were again obtained.

Platesetter

A platesetter of the Flat Bed, Internal Drum or External Drum could be constructed using a Clark laser or a Fianium laser, or other fast-pulsing laser, as the imaging tool. It could be used to image the range of different printing plates described in Example Set 1, having a number of different imaging chemistries, and in Example Sets 2 and 3, which are uncoated anodised printing surfaces.

The invention claimed is:

1. An imaging apparatus comprising, in combination:

a laser; and at least two different lithographic printing form precursors able to be located in the imaging apparatus for imaging by the laser, wherein the at least two different lithographic printing form precursors are selected from:

a lithographic printing form precursor having an aluminium oxide imaging surface which does not have sensitised imaging chemistry, a lithographic printing form precursor having an imaging surface comprising a coating of sensitised imaging chemistry responsive to radiation of wavelength with the range 150 nm to 700 nm, and a lithographic printing form precursor having an imaging surface comprising a coating of sensitised imaging chemistry responsive to radiation of wavelength within the range 700 nm to 1400 nm, wherein the laser is adapted to deliver, in an imagewise manner, pulsed electromagnetic energy of pulse duration not greater than $1\times10^6$ seconds, pulse energy of at least 0.1 μJ and up to and not to exceed 50 μJ, and fluence of said pulse of at least 50 mJ/cm$^2$ to image the imaging surfaces of the at least two different types of lithographic printing form precursors irrespective of any sensitised imaging chemistry which the printing form precursors may have.

2. The imaging device of claim 1, wherein the laser is configured to deliver the pulsed electromagnetic energy to at least two printing form precursors selected from a group consisting of:

(i) a first printing form precursor, having an imaging surface which does not have sensitised imaging chemistry;

(ii) a second printing form precursor having an imaging surface which has sensitised imaging chemistry responsive to radiation of wavelength within the range 150 to 700 nm; and (iii) a third printing form precursor having an imaging surface which has sensitised imaging chemistry responsive to radiation of wavelength within the range 700 to 1400 nm.

3. The imaging device of claim 2 in combination with at least two of the printing form precursors.

4. The device of claim 1, wherein the laser is operable to deliver pulses of a duration not greater than $1\times10^{-12}$ seconds.

5. The device of claim 4, wherein the laser is operable to deliver pulses of a duration not greater than $1\times10^{-13}$ seconds.

6. The device of claim 1, wherein the laser is operable to deliver pulses of a duration of at least $1\times10^{-18}$ seconds.

7. The device of claim 1, wherein the laser is operable to deliver pulses of a duration not greater than $1\times10^{-7}$ seconds.

8. A method of individually imaging printing form precursors selected from a plurality of types of printing form precursors using a single imaging device having at least one laser delivering, in an imagewise manner, pulsed electromagnetic radiation of pulse duration not greater than $1\times10^{-6}$ seconds and fluence of said pulse of at least 50 mJ/cm$^2$, wherein the types of printing form precursors imaged in the method includes at least two printing form precursors selected from a group consisting of:

(i) a first lithographic printing form precursor, having an aluminium oxide imaging surface which does not have sensitised imaging chemistry, wherein the aluminium oxide imaging surface is modified by the pulsed electromagnetic radiation;

(ii) a second lithographic printing form precursor having an imaging surface comprising a coating of sensitised imaging chemistry responsive to radiation of wavelength within the range 150 to 700 nm, wherein the coating is modified by the pulsed electromagnetic radiation; and (iii) a third lithographic printing form precursor having an imaging surface comprising a coating of sensitised imaging chemistry responsive to radiation of wavelength within the range 700 to 1400 nm, wherein the coating is modified by the pulsed electromagnetic radiation.

9. The method of claim 8, wherein the pulses are of duration not greater than $1\times10^{-12}$ seconds.

10. The method of claim 8, wherein the pulses are of duration not greater than $1\times10^{-13}$ seconds.

11. The method of claim 10 wherein the pulses are of duration at least $1\times10^{-18}$ seconds.

12. The method of claim 8 wherein printing form precursor of type (i) is restored to an undifferentiated condition after a first imaging and printing stage and used in one or more subsequent imaging and printing stage(s).

13. The method of claim 8, wherein the sensitised imaging chemistry of printing form precursor type (ii) is responsive to electromagnetic radiation of wavelength within the range 280 and 420 nm, most preferably between 350 and 420 nm.

14. The method of claim 8, wherein the sensitised imaging chemistry of printing form precursor type (iii) is responsive to electromagnetic radiation of wavelength between 750 and 1200 nm.

15. The method of claim 8, wherein types of printing form precursors imaged are selected from a group consisting of:

a printing form precursor whose imaging surface does not have any sensitised imaging chemistry but which is switched from hydrophobic to hydrophilic by the imaging device;

a positive working analogue printing form precursor having an imaging surface with a sensitised imaging chemistry responsive to radiation between 190 and 420 nm, preferably between 350 and 420 nm;

a negative working analogue printing form precursor having an imaging surface with a sensitised imaging chemistry responsive to radiation of wavelength between 190 and 420 nm, preferably between 350 and 420 nm;

a thermally sensitive digital positive working printing form precursor having an imaging surface responsive to radiation of wavelength between 700 and 1400 nm, preferably between 750 and 1200 nm;

a thermally sensitive digital negative working printing form precursor having an imaging surface responsive to radiation of wavelength between 700 and 1400 nm, preferably between 750 and 1200 nm;

a UV/visibly sensitive digital (Computer to Plate, CtP) negative working printing form precursor having an imaging surface responsive to radiation of wavelength between 280 and 700 nm, preferably between 350 and 700 nm;

a printing form precursor adapted to be imaged by ablation of its surface, when exposed to suitable radiation of any wavelength;

a printing form precursor with coating chemistry, for example silver halide chemistry, which causes it to be imaged when exposed to radiation between 200 to 1200 nm, preferably between 320 and 740 nm;

a single use printing form precursor with a polymer, metal, metal uncoated oxide or ceramic printing surface that does not need any processing (development); and a multi-use uncoated printing form precursor with a polymer, metal oxide or ceramic printing surface that does not need any processing (development).

16. The method of claim 8, wherein the at least one laser delivers pulsed electromagnetic radiation of pulse duration not greater than $1\times10^{-7}$ seconds.

17. A lithographic printing form imaged by a method comprising:

individually imaging a printing form precursor selected from a plurality of types of printing form precursors using a single imaging device having at least one laser delivering, in an imagewise manner, pulsed electromagnetic radiation of pulse duration not greater than $1\times10^{-6}$ seconds and fluence of said pulse of at least 50 mJ/cm$^2$, wherein the types of lithographic printing form precursors imaged in the method include at least two of the following:

(i) a first lithographic printing form precursor, having an aluminium oxide imaging surface which does not have sensitised imaging chemistry;

(ii) a second lithographic printing form precursor having an imaging surface comprising a coating of sensitised imaging chemistry responsive to radiation of wavelength within the range 150 to 700 nm; or (iii) a third lithographic printing form precursor having an imaging surface comprising a coating of sensitised imaging chemistry responsive to radiation of wavelength within the range 700 to 1400 nm.

18. The lithographic printing form of claim 17, wherein the at least one laser delivers pulsed electromagnetic radiation of pulse duration not greater than $1\times10^{-7}$ seconds.

* * * * *